US005385573A

United States Patent [19]

Wright

[11] Patent Number: 5,385,573

[45] Date of Patent: Jan. 31, 1995

[54] INFANT TEETHER AND HAND PUPPET COMBINATION

[76] Inventor: Barry M. Wright, 3154 Lehigh St., Caledonia, N.Y. 14423

[21] Appl. No.: 186,340

[22] Filed: Jan. 25, 1994

[51] Int. Cl.[6] ..... A61J 17/00

[52] U.S. Cl. ..... 606/235; 606/234; 446/28

[58] Field of Search ..... 606/234–236, 606/1; D24/194–199; 601/139–142; 446/26, 28; 15/167.1, 143.1

[56] References Cited

U.S. PATENT DOCUMENTS 1,279,615 9/1918 Van Meter ..... 606/234
2,688,961 9/1954 Thomas ..... 606/235
3,442,267 5/1969 Krygier ..... 606/235
4,188,747 7/1980 Kramer ..... 606/234
4,277,910 7/1981 Kramer ..... 606/234

*Primary Examiner*—Stephen C. Pellegrino
*Assistant Examiner*—Glenn K. Dawson
*Attorney, Agent, or Firm*—Robert J. Bird

[57] ABSTRACT

A teething puppet includes a teether embodied in a hand puppet. The hand puppet includes a mitten for a baby's hand. The mitten is the upper torso of the puppet. The teether includes a handle end inside the mitten for gripping by the baby and a bite end outside the mitten. The bite end of the teether is also the head and face of the puppet.

2 Claims, 1 Drawing Sheet

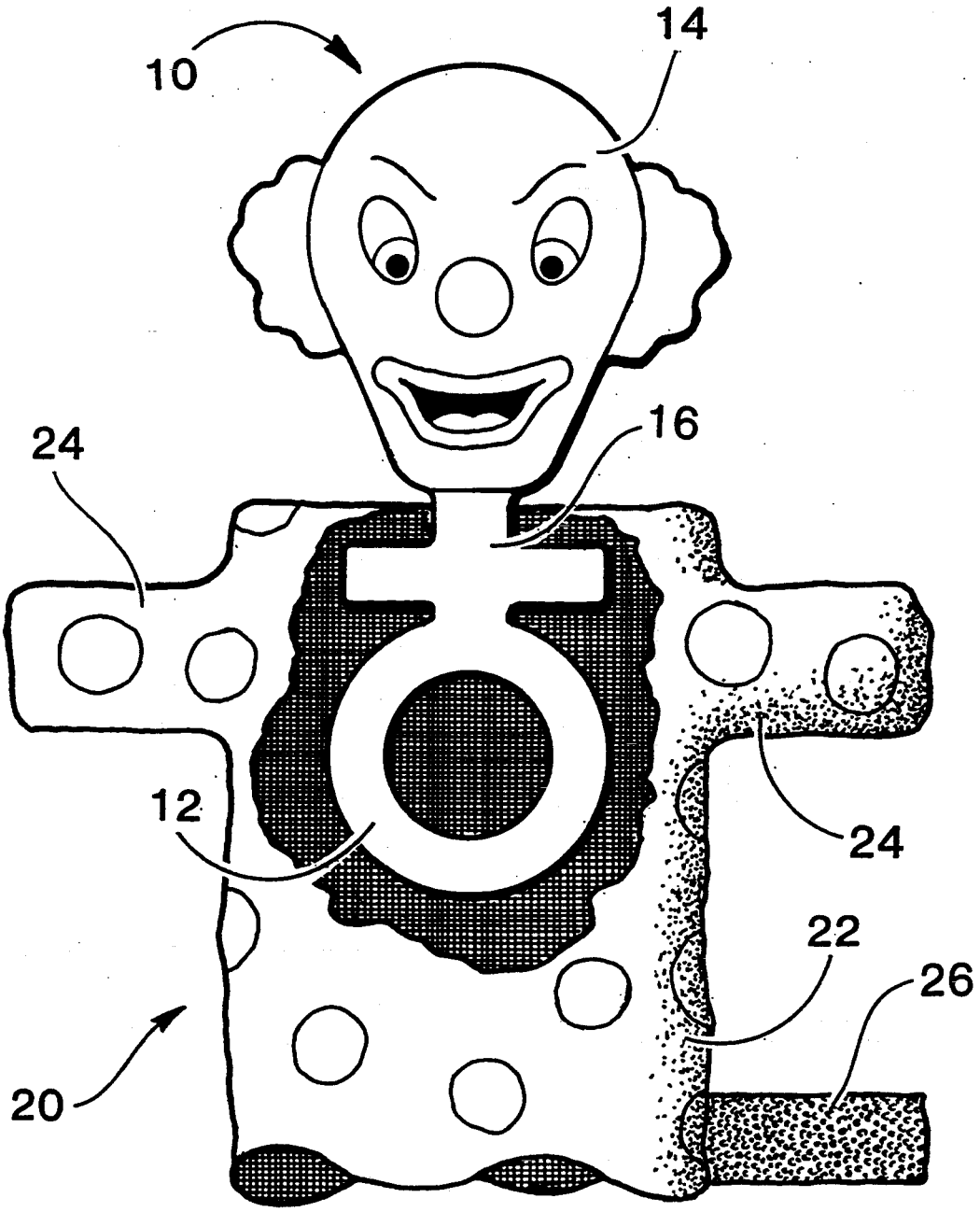
10
14
16
24
12
24
22
26
20

INFANT TEETHER AND HAND PUPPET COMBINATION

FIELD OF THE INVENTION

This invention is a combination teething device and puppet for a baby.

BACKGROUND INFORMATION

A teething ring, or teether, is a device for a teething baby to bite on. The biting activity relieves the pain of teething, and also helps the new teeth to break through the gum line. A typical teether is formed of elastomeric material. It is not made for aesthetic appeal or for useful combination with any other device or article. It is unattached and free to be thrown, unless it is secured to the baby's garment by a string and safety pin. A baby does not hold a teether for any length of time because muscle coordination and motor skills are not yet sufficiently developed, and so teethers are often misplaced, which is a source of frustration for both baby and parent. Teethers also get dirty and unsanitary from being often on the floor.

It is an object of this invention to provide a teether which has secondary use as a puppet, and which is adapted to be worn on the hand like a mitten for both its primary teething use and for its secondary puppet use. In the prior art, U.S. Pat. No. 4,188,747 to Kramer discloses a receptacle for placement of a baby's pacifier when not in use. The receptacle is a stuffed animal with an orifice or pouch suitably located, as on the tip of a nose, ear, or arm, to receive the pacifier.

SUMMARY OF THE INVENTION

The present invention is a teething puppet, including a teether embodied in a hand puppet. The hand puppet includes a mitten for a baby's hand. The mitten is the upper torso of the puppet. The teether includes a handle end inside the mitten for gripping by the baby, a bite end outside the mitten, and a stem connecting the handle and bite ends. The bite end of the teether is also the head and face of the puppet. The baby wearing the mitten can, at will, grip the handle and manipulate the teether or relax its grip without dropping the teether.

DRAWING

The drawing is a front view of my combination teether and hand puppet.

DESCRIPTION

In the drawing, a combination teether and hand puppet includes a teether 10 embodied in a hand puppet 20. The teether 10 includes a handle portion 12 at one end, a bite portion 14 at the other end, and a connecting stem 16. The hand puppet 20 includes a mitten 22 to cover a baby's hand. The mitten 22 has arms 24 to give the puppet an upper torso appearance. The lower open end of the mitten 22 includes a closure tab 26 to wrap around the lower mitten and, by means of Velcro fastening material or a snap, to secure the mitten to the baby. An elastic band might also be used. The handle portion 12 of the teether is inside the mitten. The bite portion 14 is outside the mitten, and provides the head and face of the hand puppet.

The puppet 20, a clown for example, is patterned and colored in a pleasing way for the baby's amusement. The bite portion 14 of the teether, being the head of the puppet, includes facial features such as eyes, nose, and mouth. The varieties of these details of appearance are practically without limit. The mitten 22 is preferably of a soft cushy fabric, and the teether 10 of a relatively hard elastomeric material. Suitable materials for these purposes are well known and are not part of this invention.

In use, the baby wears the mitten 22 and grips the handle 12 of the teether to manipulate the teether. The baby periodically discontinues use of the teether and relaxes its grip, but the teether stays within reach, so to speak, because the mitten stays on the baby's hand. The baby can start, stop, and resume use of the teether at will, without dropping it repeatedly. In addition to this teething advantage, my device also gives the baby added opportunity to practice and develop motor skills through manipulation of the teether. Incidentally, the arms 24 of the puppet are not intended for the baby's fingers, but the arms complete the upper torso of the puppet, and of course they move with movement of the baby's hand.

The foregoing description of a preferred embodiment of this invention, including any dimensions, angles, or proportions, is intended as illustrative. The concept and scope of the invention are limited only by the following claims and equivalents thereof.

What is claimed is:

1. A combination teether ring and hand puppet;

said hand puppet including a mitten of soft fabric to fit on a baby's hand, said mitten including sleeves extending therefrom, said mitten and sleeves respectively constituting body and arms of said puppet;

said teether ring including a handle portion and a bite portion at opposite ends of a connecting stem, said bite portion being of a relatively hard elastomeric material;

said mitten surrounding said connecting stem, said handle portion being inside said mitten and adapted for gripping by said baby, said bite portion being outside said mitten and constituting head and face of said puppet;

whereby said baby wearing said mitten can alternatively grip said handle to manipulate said teether, and relax its grip without dropping said teether.

2. A combination teether ring and hand puppet as defined in claim 1, said mitten further including means to embrace said baby's wrist to secure said mitten in place.

* * * * *